US005786307A

United States Patent [19]

Igarashi et al.

[11] Patent Number: 5,786,307

[45] Date of Patent: Jul. 28, 1998

[54] LUBRICATING OIL COMPOSITION

[75] Inventors: Jinich Igarashi; Kazuhiro Yagishita; Kiyoshi Azami, all of Yokohama, Japan

[73] Assignee: Nippon Oil Co., Ltd., Tokyo, Japan

[21] Appl. No.: 736,073

[22] Filed: Oct. 23, 1996

[30] Foreign Application Priority Data

Oct. 27, 1995 [JP] Japan ..... 7-303495

[51] Int. Cl.[6] ..... C10M 129/28; C10M 141/12

[52] U.S. Cl. ..... 508/365; 508/375; 508/378; 508/539; 508/459

[58] Field of Search ..... 508/375, 365, 508/459

[56] References Cited

U.S. PATENT DOCUMENTS

| | | | |
|---|---|---|---|
| 4,529,526 | 7/1985 | Inoue et al. | 508/365 |
| 4,648,985 | 3/1987 | Thorsell et al. | 508/365 |
| 4,832,867 | 5/1989 | Seiki et al. | 508/365 |
| 4,867,890 | 9/1989 | Colclough et al. | 508/365 |
| 5,356,547 | 10/1994 | Arai et al. | 508/364 |

FOREIGN PATENT DOCUMENTS

| | | |
|---|---|---|
| 0 024 146 A1 | 2/1981 | European Pat. Off. . |
| 0 113 045 A1 | 7/1984 | European Pat. Off. . |
| 0 304 011 A1 | 2/1989 | European Pat. Off. . |
| 0 317 348 A1 | 5/1989 | European Pat. Off. . |
| 0 418 680 A2 | 3/1991 | European Pat. Off. . |
| 3-106995 (A) | 5/1991 | Japan . |
| WO 95/07962 | 3/1995 | WIPO . |

*Primary Examiner*—Ellen M. McAvoy

*Attorney, Agent, or Firm*—Panitch Schwarze Jacobs & Nadel, P.C.

[57] ABSTRACT

A lubricating oil composition useful for internal combustion engines comprises a base oil, and, as combined therewith, specified amounts of a molybdenum dialkyldithiocarbamate, a selected zinc dihydrocarbyl dithiophosphate and a selected copper carboxylate, respectively. The oil composition exhibits a high friction-reducing effect when the oil is fresh and maintains the same effect even after the oil has been deteriorated.

15 Claims, No Drawings

LUBRICATING OIL COMPOSITION

BACKGROUND OF THE INVENTION

1. Field of the Invention

This invention relates to lubricant compositions and more particularly such a lubricating oil composition which is useful for internal combustion engines.

2. Prior Art

With ever growing numbers of automobile owners during the recent years, there has been a concomitant increase in the consumption of fuels, posing a threat to the problems of fossil fuel preservation and environmental protection. Therefore, saving of automobile fuels has been a crucial factor and at the same time, research efforts have been directed to the availability of high-quality lubricants suitable for use in automobile engine systems.

It has been proposed for minimized fuel consumption firstly to reduce the viscosity of a lubricating oil with a view to decreasing friction loss under fluid lubrication and secondly to resort to the use of friction-reducing agents with a view to decreasing friction loss under mixed and boundary lubrication conditions. Such friction-reducing agents have been widely used and a variety of compounds therefor have been introduced. A typical example is an organomolybdenum compound whose usage has been long explored to achieve the intended results.

The present inventors have previously proposed to provide a lubricating oil which incorporates a molybdenum thiocarbamate in a hydrocracked low-aromatics base oil thereby affording sustainable friction reducing effects, as disclosed in Japanese Laid-Open Patent Publication 3-106995.

SUMMARY OF THE INVENTION

It has now been found after extensive research that the combination in a base oil of a molybdenum dialkyldithiocarbamate with a selected zinc dihydrocarbyl dithiophosphate and a selected copper carboxylate can provide a surprisingly effective lubricating oil composition useful for internal combustion engines.

Therefore, the present invention seeks to provide an improved lubricating oil composition for internal combustion engines which is capable of exhibiting the effect of friction reduction in a fresh oil and maintaining the same effect in a used oil over extended periods of time.

According to the invention, there is provided a lubricating oil composition which comprises a base oil, 0.01–5.0 mass % of a zinc dihydrocarbyl dithiophosphate of the formula

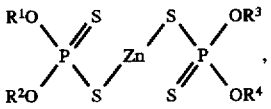

(I)

wherein $R^1$–$R^4$ inclusive each independently are a $C_1$–$C_{18}$ hydrocarbon group; 0.001–5.0 mass % of a molybdenum dialkyldithiocarbamate of the formula

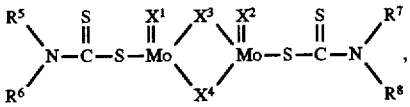

(II)

wherein $R^5$–$R^8$ inclusive each independently are a $C_1$–$C_{18}$ alkyl group and $X^1$–$X^4$ inclusive each independently are a sulfur or oxygen atom; and 0.005–1.0 mass % of a copper carboxylate of the formula

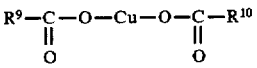

(III)

wherein $R^9$–$R^{10}$ each independently are a $C_1$–$C_{24}$ hydrocarbon group, said percentages being based on total composition.

According to a preferred embodiment of the invention, the inventive composition is prepared by contacting the formulae (II) and (III) components together in the absence of, or prior to the incorporation of the formula (I) component.

According to another preferred embodiment of the invention, the lubricating oil composition further incorporates a zinc dialkyldithiocarbamate of the formula

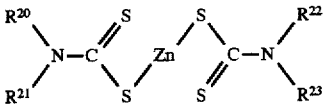

(IV)

wherein $R^{20}$–$R^{23}$ inclusive each independently are a $C_1$–$C_{18}$ alkyl group.

DETAILED DESCRIPTION OF THE INVENTION

The term base oil as used herein designates, though not restrictively, any conventional lubricant oil whether mineral or synthetic.

Suitable mineral oils may be atmospheric or vacuum distillates which are subjected to solvent deasphalting, solvent extraction, hydrocracking, solvent dewaxing, hydrodewaxing, hydrorefining, sulfuric acid treatment, clay treatment and the like. Two or more of these refining processes may be combined to produce paraffinic or naphthenic mineral oils for use as the base oil in the invention.

Synthetic lubricant base oils eligible for the purpose of the invention include polyalpha-olefin oligomers such as polybutene, 1-octane oligomer and 1-decene oligomer, alkylbenzenes, alkyl naphthalenes, diesters such as di-2-ethylhexyl adipate and sebacase, diisodecyl adipate, ditridecyl adipate and ditridecyl glutarate, polyesters such as trimellitic acid ester, polyol esters such as trimethylolpropane caprylate, trimethylolpropane pelargonate, pentaerythritol-2-ethyl hexanoate, pentaerythritol pelargonate and polyoxyalkylene glycol, polyphenyl ether and dialkyldiphenyl ether.

These mineral or synthetic oils may be used in any combination and at any ratio depending upon the particular application.

The base oils referred to herein have kinematic viscosities at 40° C. in the range of 1–1,000 $mm^2/s$, preferably 5–800 $mm^2/s$, although there is no particular restriction for the purpose of the invention.

The zinc dihydrocarbyl dithophosphate used in the invention is represented by the formula

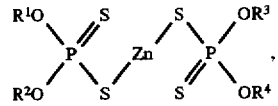

(I)

wherein $R^1$–$R^4$ inclusive each independently are a $C_1$–$C_{18}$ hydrocarbon group.

The hydrocarbon group referred to above exemplarily includes an alkyl group of 1–18 carbon atoms such as those of methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl; an alkenyl group of 4–18 carbon atoms such as those of straight or branched butenyl, straight or branched pentenyl, straight or branched hexenyl, straight or branched heptenyl, straight or branched doctenyl, straight or branched noneyl, straight or branched ndecenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl and straight or branched octadecenyl; a cycloalkyl group of 5–7 carbon atoms such as those of cyclopentyl, cyclohexyl and cycloheptyl; an alkylcycloalkyl group of 6–11 carbon atoms such as those of methylcyclopentyl, dimethylcyclopentyl (inclusive of all isomers), methylethylcyclopentyl (inclusive of all isomers), diethylcyclopentyl (inclusive of all isomers), methylcyclohexyl, dimethylcyclohexyl (inclusive of all isomers), methylethylcyclohexyl (inclusive of all isomers), diethylcyclohexyl (inclusive of all isomers), methylcycloheptyl, dimethylcycloheptyl (inclusive of all isomers), methylethylcycloheptyl (inclusive of all isomers) and diethylcycloheptyl (inclusive of all isomers); an aryl group such as those of phenyl and naphthyl; an alkylaryl group of 7–18 carbon atoms such as those of tolyl (inclusive of all isomers), xylyl (inclusive of all isomers), ethylphenyl (inclusive of all isomers), straight or branched propylphenyl (inclusive of all isomers), straight or branched butylphenyl (inclusive of all isomers), straight or branched pentylphenyl (inclusive of all isomers), straight or branched hexylphenyl (inclusive of all isomers), straight or branched heptylphenyl (inclusive of all isomers), straight or branched octylphenyl (inclusive of all isomers), straight or branched nonylphenyl (inclusive ofoall isomers), straight or branched decylphenyl (inclusive of all isomers), straight or branched undecylphenyl (inclusive of all isomers) and straight or branched dodecylphenyl (inclusive of all isomers); an arylalkyl group of 7–12 carbon atoms such as those of benzyl, phenylethyl, phenylpropyl (including isomers of propyl group), phenylbutyl (including isomers of butyl group), phenylpentyl (including isomers of pentyl group) and phenylhexyl (including isomers of hexyl group).

The above alkyl and alkenyl groups may be those of primary, secondary or tertiary.

It has been found that the use of such a zinc dialkyldithiophosphate which contains straight or branched $C_1$–$C_{18}$ alkyl groups is particularly conducive to the production of a lubricant composition having high friction-reducing and friction-inhibiting capabilities.

Specific examples of the formula (I) component include zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-n-octyldithiophosphate, zinc di-2-ethylhexyldithiophosphate, zinc di-n-decyldithiophosphate, zinc di-n-dodecyldithiophosphate, zinc diisotridecyldithiophosphate and mixtures thereof.

The content of the component (I) based on the total amount of the lubricating oil composition is in the range of from 0.01, preferably 0.1 mass % to 5.0, preferably 2.0 mass %. Contents less than 0.01 mass % would fail to achieve any significant friction reduction of a fresh lubricant, while contents greater than 5.0 mass % would be merely uneconomical with no particular improvement.

The molybdenum dialkyl dithiocarbamate used in the invention is represented by the formula

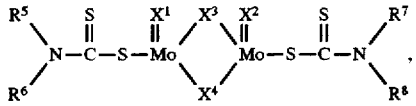

(II)

wherein $R^5$–$R^8$ inclusive each independently are a $C_1$–$C_{18}$ alkyl group such as those of methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl and straight or branched octadecyl.

Particularly preferred among the above alkyl groups are $R^4$–$R^{13}$ alkyl groups which are contributory to enhanced reduction in the friction of the inventive composition when fresh and sustained friction reduction effect.

The above alkyl groups may be primary, secondary or tertiary as the case may be.

The designations $X^1$–$X^4$ inclusive in formula (II) each independently are a sulfur or oxygen atom, but at least one such atom should be sulfur with a view to achieving friction-reduction in the inventive oil composition when fresh.

Two or more molybdenum compounds of formula (II) may be used in combination, in which instance the atom group of the formula

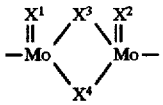

(A)

may be represented in its average structure by $—Mo_2SaO_{(x-a)}—$ where a is preferably 1–3, more preferably 1.5–2.5 with a view to ensuring friction-reduction of a fresh lubricant composition and corrosion-resistance of bearings and other mechanical parts of the engine.

Specific preferred examples of the molybdenum dialkyl dithiocarbamate include molybdenum sulfide di(straight or branched)butyldithiocarbamate, molybdenum sulfide di(straight or branched)pentyldithiocarbamate, molybdenum sulfide di(straight or branched)hexyldithiocarbamate, molybdenum sulfide di(straight or branched) heptyldithiocarbamate, molybdenum sulfide di(straight or branched)octyldithiocarbamate, molybdenum sulfide di(straight or branched)nonyldithiocarbamate, molybdenum sulfide di(straight or branched)decyldithiocarbamate, molybdenum sulfide di(straight or branched) undecyldithiocarbamate, molybdenum di(straight or branched)dodecyldithiocarbamate, molybdenum di(straight or branched)tridecyldithiocarbamate, oxymolybdenum sulfide di(straight or branched)butyldithiocarbamate, oxymolybdenum sulfide di(straight or branched) pentyldithiocarbamate, oxymolybdenum sulfide di(straight or branched)hexyldithiocarbamate, oxymolybdenum sulfide di(straight or branched)heptyldithiocarbamate, oxymolybdenum sulfide di(straight or branched)octyldithiocarbamate, oxymolybdenum sulfide di(straight or branched) nonyldithiocarbamate, oxymolybdenum sulfide di(straight or branched)decyldithiocarbamate, oxymolybdenum sulfide di(straight or branched)undecyldithiocarbamate, oxymolybdenum sulfide di(straight or branched) dodecyldithiocarbamate, oxymolybdenum sulfide di(straight or branched)tridecyldithiocarbamate and mixtures thereof.

The content of the component (II) is in the range of from 0.01, preferably 0.1 mass % to 5.0, preferably 3.0 mass % based on total composition. Departures from this range would be disadvantageous for the purpose of the invention.

The copper carboxylate used in the invention is represented by the formula

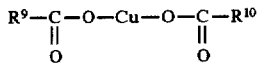

(III)

wherein $R^9$ and $R^{10}$ each are a $C_1$–$C_{24}$ hydrocarbon groups such as an alkyl group of 1–24 carbon atoms such as those of methyl, ethyl, n-propyl, isopropyl, n-butyl, isobutyl, sec-butyl, tert-butyl, straight or branched pentyl, straight or branched hexyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched eicosyl, straight or branched heneicosyl, straight or branched docosyl, straight or branched tricosyl and straight or branched tetracosyl; an alkenyl group of 4–24 carbon atoms such as those of straight or branched butenyl, straight or branched pentenyl, straight or branched hexenyl, straight or branched heptenyl, straight or branched octenyl, straight or branched noneyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched nonadecenyl, straight or branched eicosenyl, straight or branched heneicosenyl, straight or branched docosenyl, straight or branched tricosenyl and straight or branched tetracosenyl; a cycloalkyl group of 5–7 carbon atoms such as those of cyclopentyl, cyclohexyl and cycloheptyl; an alkylcycloalkyl group of 6–24 carbon atoms such as those of methylcyclopentyl, dimethylcyclopentyl (inclusive of all isomers), methylethylcyclopentyl (inclusive of all isomers), diethylcyclopentyl (inclusive of all isomers), methylcyclohexyl, dimethylcyclohexyl (inclusive of all isomers), methylethylcyclohexyl (inclusive of all isomers), diethylcyclohexyl (inclusive of all isomers), methylcycloheptyl, dimethylcycloheptyl (inclusive of all isomers), methylethylcycloheptyl (inclusive of all isomers) and diethylcycloheptyl (inclusive of all isomers); $C_6$–$C_{24}$ saturated hydrocarbon group portions free of carboxylic acid groups of $C_7$–$C_{25}$ naphthenic acids (generally saturated carboxylic acids having naphthene nuclea) which is a predominant component of a petroleum acid;an aryl group such as those of phenyl and naphthyl; an alkylaryl group of 7–18 carbon atoms such as those of tolyl (inclusive of all isomers), xylyl (inclusive of all isomers), ethylphenyl (inclusive of all isomers), straight or branched butylphenyl (inclusive of all isomers), straight or branched pentylphenyl (inclusive of all isomers), straight or branched hexylphenyl (inclusive of all isomers), straight or branched heptylphenyl (inclusive of all isomers), straight or branched octylphenyl (inclusive of all isomers), straight or branched nonylphenyl (inclusive ofoall isomers), straight or branched decylphenyl (inclusive of all isomers), straight or branched undecylphenyl (inclusive of all isomers) and straight or branched dodecylphenyl (inclusive of all isomers); an arylalkyl group of 7–12 carbon atoms such as those of benzyl, phenylethyl, phenylpropyl (including isomers of propyl group), phenylbutyl (including isomers of butyl group), phenylpentyl (including isomers of pentyl group) and phenylhexyl (including isomers of hexyl group).

The $C_6$–$C_{24}$ saturated hydrocarbon group portion as above defined normally embraces $C_6$–$C_{24}$ (alkyl) cyclopentylalkyl groups of the formula

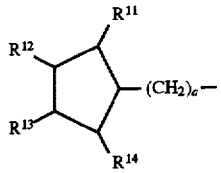

(V)

wherein $R^{11}$–$R^{14}$ inclusive each independently are a hydrogen atom, methyl or ethyl group and a is an integer of 1–18; or $C_7$–$C_{24}$ (alkyl) cyclohexylalkyl groups of the formula

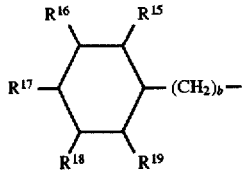

(VI)

wherein $R^{15}$–$R^{19}$ inclusive each independently are a hydrogen atom, methyl or ethyl group and b is an integer of 1–18.

Preferred compounds of formula (III) are those copper carboxylates in which $R^9$ and $R^{10}$ each independently are a $C_8$–$C_{24}$ alkyl group, $C_8$–$C_{24}$ alkenyl group, $C_8$–$C_{24}$ alkylcycloalkyl group or a $C_8$–$C_{24}$ saturated hydrocarbon group portion free of carboxyl groups in $C_9$–$C_{25}$ naphthenic acids. Such copper carboxylates are particularly desirable in terms of solubility in the lubricant composition and oxidative stability. Two or more of the specified copper carboxylates may be blended in suitable proportions.

Specific examples of the component (III) eligible for use in the invention include copper 2-ethylhexanate, copper n-dodecanate (copper laurate), copper isododecanate, copper n-octadecanate (copper stearate), copper oleate, $C_9$–$C_{25}$ copper naphthenate and mixtures thereof.

The content of the component (III) is in the range of from 0.005, preferably 0.01 mass % to 1.0, preferably 0.5 mass %. Contents less than 0.005 mass % would fail in sustained friction-reducing effect, while contents more than 1.0 mass % would be not only economically infeasible but would also lead to accelerated deterioration of the composition.

For ease of handling, the components (I)–(III) may be diluted with solvents or lubricants.

According to a preferred embodiment of the invention, the inventive composition is prepared by contacting the components (II) and (III) together in the absence of, or prior to the incorporation of the component (I). The contacting referred to herein may be effected by means of for example stirring with the use of a propeller mixer or a honeycomb mixer at a temperature of above 40° C., preferably in the range of 60° C.–below 100° C., more preferably not exceeding 90° C.

Temperatures below 40° C. would be inadequate for the intended contact, and temperatures exceeding 100° C. would result in undesirable happening such as decomposition of the molybdenum dialkyl dithiocarbamate. Suitable contact time lengths, though not restrictively, may be more than 30 minutes, preferably more than 60 minutes but not more than 3 hours, preferably less than 2 hours, to attain optimum contact between components (II) and (III).

After components (II) and (III) have been contacted together, then component (I) is incorporated at a temperature of above 40° C., preferably from above 50° C. to below 90° C., more preferably below 80° C. Temperatures below 40° C. would lead to prolonged dissolution of the zinc dihydrocarbyl dithiophosphate in the base oil, while temperatures above 90° C. would invite decomposition of that zinc compound. The incorporation of component (I) is effected over a time length of more than 30 minutes, preferably more than 60 minutes but not exceeding 3 hours, more preferably less than 90 minutes. Departures from this range of time lengths would lead to the same results as aforementioned.

The incorporation of component (I) referred to herein is effected by means of stirring as by a propeller or honeycomb mixer.

A typical process of preparing the inventive composition comprises adding the base oil with two components (II) and (III) either together or separately and contacting them together at 40°–100° C. followed by the incorporation of component (I).

An alternative process is to add the base oil with a contact product of components (II) and (III) simultaneously with or separately from component (I).

Another alternative process is to add the base oil with the contact product of components (II) and (III) as mixed with component (I).

According to another preferred embodiment of the invention, the lubricating oil composition further comprises a zinc dialkyldithiocarbamate of the formula

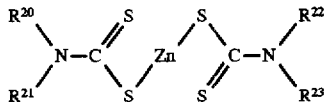

(IV)

wherein $R^{20}$–$R^{23}$ inclusive each independently are a $C_1$–$C_{18}$ alkyl group. The alkyl groups in the above component (IV) are the same as already described in connection with the component (II), and particularly preferred are $C_4$–$C_{13}$ alkyl groups which are conducive to the maintenance of friction-reducing ability of the product composition.

Specific preferred examples of the component (IV) include zinc di(straight or branched)butyldithiocarbamate, zinc di(straight or branched)pentyldithiocarbamate, zinc di(straight or branched)hexyldithiocarbamate, zinc di(straight or branched)heptyldithiocarbamate, zinc di(straight or branched)octyldithiocarbamate, zinc di(straight or branched)nonyldithiocarbamate, zinc di(straight or branched)decyldithiocarbamate, zinc di(straight or branched)undecyldithiocarbamate, zinc di(straight or branched)dodecyldithiocarbamate, zinc di(straight or branched)tridecyldithiocarbamate and mixtures thereof.

The content of component (IV) is in the range of from 0.01, preferably 0.1 mass % to 5.0, preferably 2.0 mass %. Departures from this range of contents would fail to achieve the intended results.

To further enhance the friction-reduction behavior of the inventive lubricating oil composition, there may be used certain conventional additives such as for example antioxidant, metallic detergent, non-ash dispersant, extreme pressure additive, antiwear agent, friction reducing angent, rust inhibitor, corrosion inhibitor, viscosity index improver, pour point depressant, rubber swelling angent, defoamer and coloring angent. These may be used singly or incombination.

Oxidation-inhibitors may be phenol-based or amine-based compounds such as alkylphenols such as 2,6-di-tert-butyl-4-methylphenol, bisphenols such as methylene-4,4-bis (2,6-di-tert-butyl-4-methylphenol), naphthylamines such as phenyl-α-naphthylamine, dialkyldiphenylamines, zinc dialkyldithiophosphates such as zinc di-2-ethylhexyldithiophosphate and phenothiazines.

Metallic detergents are exemplarily alkaline earth metal sulfonate, alkaline earth metal phenolate, alkaline earth metal salicylate and alkaline earth metal phosphonate.

Non-ash dispersants are exemplarily alkenylsuccinimide, benzylamine, alkylpolyamine or those modified with boron compound or sulfur compound and ester alkenylsuccinate.

Extreme-pressure additives and anti-friction agents may include sulfur-based compounds such as disurfides, olefin surfides and sulfurized fats and oils and phosphorus-based compounds such as monoester phosphates, diester phosphates, triester phosphates, monoester phosphites, diester phosphites, triester phosphites and amine salts and alkanolamine salts of these esters.

Friction-reducing agents are exemplarily aliphatic alcohol, fatty acid, ester of fatty acid, aliphatic amine, aliphatic amine salt and fatty acid amide. Rust inhibitor are exemplarily alkenylsuccinic acid, ester alkenylsuccinate, polyhydric alcohol ester, petroleum sulfonate and dinonylnaphthalenesulfonate. Corrosion inhibitors are exemplarily compound of benztriazoles, thiodiazoles and imidazoles. Viscosity index improver are exemplarily non-dispersant type and dispersant type such as polymethacrylates and olefin copolymers such as ethylene-propylene copolymer, polyisobutylene, polystyrene and styrene-diene copolymer. Pour point depressants may be selected from polymer of polymethacrylates, depending on the based oil in use. Anti-forming agents are exemplarily silicones such as polydimethylsiloxane and fluorosilicone.

Antiforming agents may be added in an amount of 0.0005–1 weight %; viscosity index improvers in an amount of 1–30 weight %; metallic inactivators in an amount of 0.005–1 weight %; and other additives in an amount of 0.1–15 weight %, all based on the total composition.

The above various additives may be added to the base oil simultaneously with or separately from components (II) and (III) and then contacted together, followed by addition of component (I), or may be alternatively added initially as mixed with component (I) such as in the form of for example SH package to the base oil simultaneously with or separately from a contact product of components (II) and (III).

The invention will be further described by way of the following examples which are provided only for illustrative purposes.

EXAMPLES 1–12

There were prepared lubricating oil compositions using the following formulations:

Base oil

Hydrocracked refined paraffine-based mineral oil containing 5 mass % of total aromatics content and having a dynamic viscosity at 100° C. of 4.0 $mm^2$/sec.

Component (I)

A: zinc diisopropyl dithiophosphate

B: zinc di-2-ethylhexyl dithiophosphate

Component (II)

C: oxymolybdenum sulfide di-2-ethylhexyldicarbamate (atom group (A) structure —$Mo_2S_2O_2$—)

D: oxymolybdenum sulfide diisotridecyl dicarbamate (atom group (A) structure —$Mo_2S_2O_2$—)

Component (III)

E: copper oleate

F: $C_8$–C24 copper naphthenate

Package

Commercially available SG class engine oil package free of zinc dithiophosphate but containing a metallic cleaning agent, non-ash dispersant, oxygen-inhibitor and corrosion-inhibitor.

Other additives

H: oxymolybdenum sulfide di-2-ethylhexyl dithiophosphate

I: 4,4'-dihydroxy-3,5,3',5'-tetra-tert-butyl diphenylmethane of the formula

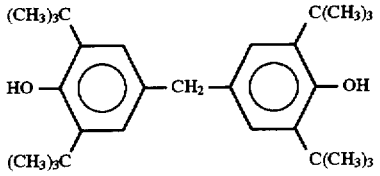

J: dioctyldiphenyl amine of the formula

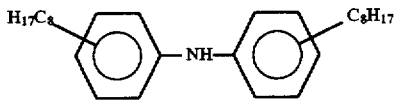

Table 1 shows the composition of each of the exemplified lubricating oils and the results of the following test.

Friction-reducing performance test

This test was conducted by the use of SRV reciprocating friction tester applied to a sample roller-disc (SUJ-2) at a frequency of 50 Hz, an amplitude of 1.5 mm, a load of 400N and a temperature of 80° C., thereby measuring the friction coefficients of the respective sample oils in both fresh and deteriorated conditions. The term deteriorated oil designates an oil resulting from oxidatively deteriorating a fresh oil at 150° C. over a period of 144 hours pursuant to the provisions of Lubricating Oil Oxidative Stability Test in JIS K2514-3.1.

It will be seen from Table 1 that the lubricants of Examples 1–5 are capable of friction reduction when the oils are either fresh or have been deteriorated. Whereas, Example 6 which is devoid of component (I) and Example 7 which is devoid of component (II) are not satisfactory in fresh oil friction reduction, while Example 8 devoid of component (III) and Example 9 using excessive component (III) are much inferior in sustained friction reducing effect. Example 10 using an oxymolybdenum sulfide dialkyl dithiophosphate in place of component (II), Example 11 using a phenol-based oxidation-inhibitor in place of component (III) and Example 12 using an aromatic amine oxidation-inhibitor in place of component (III) are all inferior to the invention in terms of sustained friction reduction.

The following examples are provided to illustrate the embodiment of the invention in which component (I) is absent when components (II) and (III) are contacted together and is incorporated after components (II) and (III) are contacted together. The above procedure of the friction-reducing performance test was followed except that the exemplified lubricating oils in a fresh condition were oxidatively deteriorated over a period of 192 hours.

EXAMPLE 13

905.5 grams (90.55 mass %) base oil was added with 3.5 gram (0.35 mass %) oxymolybdenum sulfide di-2-ethylhexyl dithiocarbamate, 1.0 gram (0.1 mass %) copper oleate and 80 grams (8.0 mass %) package the indicated amounts being based on total composition. The admixture was heated with stirring at 80° C. for 2 hours, followed by addition of 10 grams (1.0 mass %) zinc diisopropyl dithiophosphate. The whole was stirred at 80° C. for another hour. The resulting oil product was tested to reveal a friction coefficient of 0.045 when fresh and a friction coefficient of 0.048 after deterioration.

EXAMPLE 14

905.5 grams (90.55 mass %) base oil was added with 3.5 gram (0.35 mass %) oxymolybdenum sulfide diisotridecyl dithiocarbamate, 1.0 gram (0.1 mass %) copper naphthenate and 80 grams (8.0 mass %) package, the indicated amounts being based on total composition. The admixture was heated with stirring at 80° C. for 2 hours, followed by addition of 10 grams (1.0 mass %) zinc di-2-ethylhexyl dithiophosphate. The whole was stirred at 80° C. for another hour. The resulting oil product was tested to reveal a friction coefficient of 0.046 when fresh and a friction coefficient of 0.050 after deterioration.

EXAMPLE 15

905.5 grams (90.55 mass %) base oil was added simultaneously with 10 grams (1.0 mass %) zinc diisopropyl dithiophosphate, 3.5 grams (0.35 mass %) oxymolybdenum sulfide di-2-ethylhexyl dithiocarbamate, 1.0 gram (0.1 mass %) copper oleate and 80 grams (8.0 mass %) package, the indicated amounts being based on total composition. The admixture was heated with stirring at 80° C. for 2 hours. The resulting oil composition was tested to reveal a friction coefficient of 0.045 when fresh and a friction coefficient of 0.055 after deterioration.

EXAMPLE 16

905.5 grams (90.55 mass %) base oil was added simultaneously with 10 grams (1.0 mass %) zinc di-2-ethylhexyl dithiophosphate, 3.5 grams (0.35 mass %) oxymolybdenum sulfide diisotridecyl dithiocarbamate, 1.0 gram (0.1 mass %) copper naphthenate and 80 grams (8.0 mass %) package, the indicated amounts being based on total composition. The admixture was heated with stirring at 80° C. for 2 hours. The resulting oil composition was tested to reveal a friction coefficient of 0.046 when fresh and a friction coefficient of 0.060 after deterioration.

EXAMPLE 17

905.5 grams (90.55 mass %) base oil was added first with 10 grams (1.0 mass %) zinc diisopropyl dithiophosphate, 3.5 grams (0.35 mass %) oxymolybdenum sulfide di-2-ethylhexyl dithiocarbamate and 80 grams (8.0 mass %) package, the indicated amounts being based on total composition. 1.0 gram (0.1 mass %) copper oleate was then added. The admixture was heated with stirring at 80° C. for 1 hour. The resulting oil composition was tested to reveal a friction coefficient of 0.045 when fresh and a friction coefficient of 0.055 after deterioration.

EXAMPLE 18

905.5 grams (90.55 mass %) base oil was added first with 10 grams (1.0 mass %) zinc diisopropyl dithiophosphate, 1.0 gram (0.1 mass %) copper oleate and 80 grams (8.0 mass %) package, the indicated amounts being based on total composition. 3.5 grams (0.35 mass %) oxymolybdenum sulfide di-2-ethylhexyl dithiocarbamate was then added. The admixture was heated with stirring at 80° C. for 1 hour. The resulting oil composition was tested to reveal a friction coefficient of 0.045 when fresh and a friction coefficient of 0.055 after deterioration.

It will be understood that the oil compositions of Examples 13 and 14 are satisfactory in their ability of exhibiting and sustaining the friction-reducing effect, whereas those of Examples 15–18 inclusive which were prepared by different sequences of addition of components (I), (II) and (III) are inferior to the inventive compositions.

EXAMPLES 19–27

Examples 11–27 shown in Table 2 are directed to another embodiment of the invention in which the lubricating oil compositions in Table 1 are further added with component (IV) as herein before described.

As seen from the results of friction-reducing performance test indicated in Table 2, the oil compositions of Examples 19–23 inclusive each are satisfactory in friction-reducing effect both when the oil is fresh and after the oil has been deteriorated. Whereas, the oil composition of Example 24 devoid of component (I) and that of Example 25 devoid of component (II) are inferior in friction reduction when the oil is fresh, while the composition of Example 26 devoid of component (III) and that of Example 27 devoid of component (IV) are not satisfactory in friction reduction as observed after the oil has been deteriorated.

TABLE 1

| | Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Composition (mass %) | | | | | | | | | | | | |
| Base oil | [90.55] | [90.55] | [90.55] | [90.55] | [90.55] | [91.55] | [90.90] | [90.65] | [89.15] | [90.55] | [90.15] | [90.15] |
| Component (I) | A [1.00] | B [1.00] | A[0.50] B[0.50] | A [1.00] | A [1.00] | — | A [1.00] | A [1.00] | A [1.00] | A [1.00] | A [1.00] | A [1.00] |
| Component (II) | C [0.35] | C [0.35] | C [0.35] | D [0.35] | C [0.35] | C [0.35] | — | C [0.35] | C [0.35] | — | C [0.35] | C [0.35] |
| Component (III) | E [0.10] | E [0.10] | E [0.10] | E [0.10] | F [0.10] | E [0.10] | E [0.10] | — | E [1.50] | E [0.10] | — | — |
| Package | [8.00] | [8.00] | [8.00] | [8.00] | [8.00] | [8.00] | [8.00] | [8.00] | [8.00] | [8.00] | [8.00] | [8.00] |
| Other additive | — | — | — | — | — | — | — | — | — | H [0.35] | I [0.50] | J [0.50] |
| SRV Test | | | | | | | | | | | | |
| friction coefficient | | | | | | | | | | | | |
| fresh oil | 0.045 | 0.043 | 0.040 | 0.048 | 0.045 | 0.062 | 0.130 | 0.045 | 0.050 | 0.047 | 0.045 | 0.045 |
| deteriorated oil | 0.051 | 0.048 | 0.048 | 0.054 | 0.052 | 0.068 | 0.120 | 0.083 | 0.068 | 0.081 | 0.073 | 0.087 |

TABLE 2

| | Examples | | | | | | | | |
|---|---|---|---|---|---|---|---|---|---|
| | 19 | 20 | 21 | 22 | 23 | 24 | 25 | 26 | 27 |
| Composition (mass %) | | | | | | | | | |
| Base oil | [90.14] | [90.14] | [90.14] | [90.14] | [90.14] | [91.14] | [90.64] | [90.49] | [90.15] |
| Component (I) | A [1.00] | B [1.00] | A [1.00] | A [1.00] | A [1.00] | — | A [1.00] | A [1.00] | A [1.00] |
| Component (II) | C [0.35] | C [0.35] | D [0.35] | C [0.35] | C [0.35] | C [0.35] | — | C [0.35] | C [0.35] |
| Component (III) | E [0.01] | E [0.01] | E [0.01] | F [0.01] | E [0.01] | E [0.01] | E [0.01] | — | E [0.01] |
| Component (IV) | G [0.50] | G [0.50] | G [0.50] | G [0.50] | H [0.50] | G [0.50] | G [0.50] | G [0.50] | — |
| Package | [8.00] | [8.00] | [8.00] | [8.00] | [8.00] | [8.00] | [8.00] | [8.00] | [8.00] |
| SRV Test | | | | | | | | | |
| friction coefficient | | | | | | | | | |
| fresh oil | 0.045 | 0.043 | 0.045 | 0.045 | 0.045 | 0.058 | 0.133 | 0.045 | 0.045 |
| deteriorated oil | 0.047 | 0.047 | 0.049 | 0.048 | 0.048 | 0.060 | 0.120 | 0.082 | 0.057 |

What is claimed is:

1. A lubricating oil composition which comprises a base oil, 0.01–5.0 mass % of a zinc dihydrocarbyl dithiophosphate of the formula

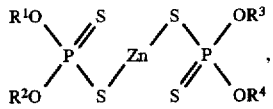

(I)

wherein $R^1$–$R^4$ inclusive each independently are a $C_1$–$C_{18}$ hydrocarbon group; 0.001–5.0 mass % of a molybdenum dialkyldithiocarbamate of the formula

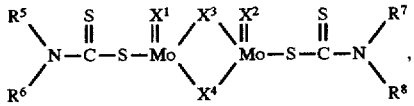

(II)

wherein $R^5$–$R^8$ inclusive each independently are a $C_1$–$C_{18}$ alkyl group and $X^1$–$X^4$ inclusive each independently are a sulfur or oxygen atom; and 0.005–1.0 mass % of a copper carboxylate of the formula

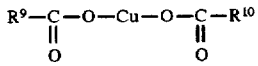

(III)

wherein $R^9$–$R^{10}$ each independently are a $C_1$–$C_{24}$ hydrocarbon group, said percentages being based on total composition.

2. A lubricating oil composition according to claim 1 which further incorporates a zinc dialkyldithiocarbamate of the formula

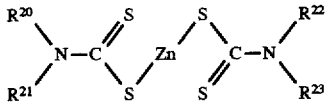

(IV)

wherein $R^{20}$–$R^{23}$ inclusive each independently are a $C_1$–$C_{18}$ alkyl group.

3. A lubricating oil composition according to claim 1 which results from mutually contacting the components of said formulae (II) and (III) at a temperature of between 40° and 100° C. in the absence of the component of said formula (I).

4. A lubricating oil composition according to claim 1 which results from incorporating the component of said formula (I) after the components of said formulae (II) and (III) have been contacted together.

5. A lubricating oil composition according to claim 1 wherein said base oil is mineral or synthetic.

6. A lubricating oil composition according to claim 1 wherein the component of said formula (I) is selected from the group consisting of zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-n-octyldithiophosphate, zinc di-2-ethylhexyldithiophosphate, zinc di-n-decyldithiophosphate, zinc di-n-dodecyldithiophosphate, zinc diisotridecyldithiophosphate and mixtures thereof.

7. A lubricating oil composition according to claim 1 wherein the component of said formula (II) is selected from the group consisting of molybdenum sulfide di(straight or branched)butyldithiocarbamate, molybdenum sulfide di(straight or branched)pentyldithiocarbamate, molybdenum sulfide di(straight or branched)hexyldithiocarbamate, molybdenum sulfide di(straight or branched) heptyldithiocarbamate, molybdenum sulfide di(straight or branched)octyldithiocarbamate, molybdenum sulfide di(straight or branched)nonyldithiocarbamate, molybdenum sulfide di(straight or branched)decyldithiocarbamate, molybdenum sulfide di(straight or branched) undecyldithiocarbamate, molybdenum di(straight or branched)dodecyldithiocarbamate, molybdenum di(straight or branched)tridecyldithiocarbamate, oxymolybdenum sulfide di(straight or branched)butyldithiocarbamate, oxymolybdenum sulfide di(straight or branched) pentyldithiocarbamate, oxymolybdenum sulfide di(straight or branched)hexyldithiocarbamate, oxymolybdenum sulfide di(straight or branched)heptyldithiocarbamate, oxymolybdenum sulfide di(straight or branched)octyldithiocarbamate, oxymolybdenum sulfide di(straight or branched) nonyldithiocarbamate, oxymolybdenum sulfide di(straight or branched)decyldithiocarbamate, oxymolybdenum sulfide di(straight or branched)undecyldithiocarbamate, oxymolybdenum sulfide di(straight or branched) dodecyldithiocarbamate, oxymolybdenum sulfide di(straight or branched)tridecyldithiocarbamate and mixtures thereof.

8. A lubricating oil composition according to claim 1 wherein the component of said formula (III) is selected from the group consisting of copper 2-ethylhexanate, copper n-dodecanate (copper laurate), copper isododecanate, copper n-octadecanate (copper stearate), copper oleate, $C_9$–$C_{25}$ copper naphthenate and mixtures thereof.

9. A lubricating oil composition according to claim 1 wherein the component of said formula (IV) is selected from the group consisting of zinc di(straight or branched) butyldithiocarbamate, zinc di(straight or branched) pentyldithiocarbamate, zinc di(straight or branched) hexyldithiocarbamate, zinc di(straight or branched) heptyldithiocarbamate, zinc di(straight or branched) octyldithiocarbamate, zinc di(straight or branched) nonyldithiocarbamate, zinc di(straight or branched) decyldithiocarbamate, zinc di(straight or branched) undecyldithiocarbamate, zinc di(straight or branched) dodecyldithiocarbamate, zinc di(straight or branched) tridecyldithiocarbamate and mixtures thereof.

10. A lubricating oil composition according to claim 1 wherein the component of said formula (II) is contained in an amount of 0.1–5.0 mass % based on total composition.

11. A lubricating oil composition according to claim 1 wherein the component of said formula (II) is contained in an amount of 0.35–5.0 mass % based on total composition.

12. A lubricating oil composition according to claim 1 wherein the component of said formula (III) is contained in an amount of 0.01–0.5 mass % based on total composition.

13. A lubricating oil composition according to claim 2 wherein the component of said formula (II) is contained in an amount of 0.1–5.0 mass % based on total composition.

14. A lubricating oil composition according to claim 2 wherein the component of said formula (II) is contained in an amount of 0.35–5.0 mass % based on total composition.

15. A lubricating oil composition according to claim 2 wherein the component of said formula (III) is contained in an amount of 0.01–0.5 mass % based on total composition.

* * * * *